United States Patent [19]

Kahale

[11] Patent Number: 4,755,639

[45] Date of Patent: Jul. 5, 1988

[54] PRESSURE SWITCH WITH CALIBRATION TAB

[75] Inventor: Abed Kahale, Hoffman Estates, Ill.

[73] Assignee: Eaton Corporation, Cleveland, Ohio

[21] Appl. No.: 114,802

[22] Filed: Oct. 28, 1987

[51] Int. Cl.[4] ..... H01K 35/34

[52] U.S. Cl. ..... 200/83 P; 200/83 WM; 200/83 SA; 74/511 R; 403/407.1; 337/319

[58] Field of Search ..... 74/107, 511 R, 516, 74/519, 522, 568 R; 403/353, 407.1; 335/42, 45; 337/117, 131, 318, 319, 320; 200/83 R, 83 S, 83 SA, 83 WM, 83 J, 83 Z, 153 L, 153 LA, 153 LB, 330, 251, 286

[56] References Cited

U.S. PATENT DOCUMENTS

| | | | |
|---|---|---|---|
| 3,596,023 | 7/1971 | Kothe | 200/83 P |
| 3,600,539 | 8/1971 | Walker | 335/41 |
| 3,845,265 | 10/1974 | Kothe | 337/319 |
| 3,846,600 | 11/1974 | Kolze | 200/83 S |
| 4,428,596 | 1/1984 | Bell | 403/353 |
| 4,617,432 | 10/1986 | Hanssen et al. | 200/83 WM |
| 4,645,228 | 2/1987 | Bertonneau | 403/407.1 |

*Primary Examiner*—G. P. Tolin

*Attorney, Agent, or Firm*—R. A. Johnston

[57] ABSTRACT

The present invention pertains particularly to low pressure level type switches employed for sensing the water level in washing appliances. The invention employs a slidable strip or tab interposed between the diaphram pre-load spring and the reaction stop for the spring. In one position the thickness of the movable tab increases the pre-load on the spring by an amount equal to the thickness of the tab. In a secod position the pre-load stop extends through a cutout in the tab and contacts the spring reaction member directly.

17 Claims, 2 Drawing Sheets

PRESSURE SWITCH WITH CALIBRATION TAB

BACKGROUND OF THE INVENTION

The present invention relates to devices for effecting actuation and deactuation of an electrical switch in response to changes in a sensed pressure. The invention particularly relates to pressure switches of the type employed in washing appliances where certain electrically operated appliance functions are activated in response to sensing the level of water in the appliance receptacle. Pressure switches of this type are typically employed for sensing water level in clothes washing machine tubs or in the cabinet of dishwashing machines and controlling an electrically operated waterfill valve, and the tub agitations motor.

Pressure switches employed for washing appliances typically employ a pressure responsive rubber diaphragm disposed in a housing having an inlet port communicating with a pressure chamber of which the diaphragm forms one wall. Typically a plunger is mounted on the diaphragm for actuating a snap-acting switch in the housing upon movement of the diaphragm in response to changes in pressure sensed through the inlet port. The plunger mechanism is usually pre-loaded by a bias spring; and, the pre-load is calibrated by adjustment of the spring compression to provide actuation of the snap-acting switch at a predetermined desired pressure. The calibration of the actuation pressure is generally set and sealed upon assembly of the pressure switch; and, the setting is thereafter unchanged unless provision is provided for adjustment by qualified field service personnel.

In certain types of washing appliances, it has been desired to provide for a means of changing the sensed pressure level or corresponding water level at which the electrical switch mechanism is actuated in the pressure switch without altering the original calibration setting of the switch. Such a change in switch pressure actuation or water level may be desirable where a smaller loading of articles to be washed is encountered and consequently less water is required. Additionally in washing machines employed in commercial or coin operated laundromats the proprietor or operator may wish to decrease the amount of water consumed by the machine during the washing cycle where a limted supply or shortage of water in the supply is encountered.

Additionally, it has been desired to provide a way or means of retrofitting pressure switches in existing commercial laundry machines to provide for allowing the machine operator to select as between two water levels in a quick and convenient manner without the necessity of altering the original calibration of the pressure switch.

SUMMARY OF THE INVENTION

The present invention provides a unique way or means of selectively changing the sensed pressure at which a pressure switch effects actuation of the electrical switching mechanism without requiring altering or resetting of the original calibration of the pressure switch. The present invention pertains particularly to low pressure level type pressure switches employed for sensing the water level in washing appliances. The invention employs a slidable strip or tab interposed between the diaphram pre-load spring and the reaction stop for the spring. In one position the thickness of the movable tab increases the pre-load on the spring by an amount equal to the thickness of the tab. In a second position the pre-load stop extends through a cutout in the tab and contacts the spring reaction member directly.

The present invention provides a simple and economical way for quickly establishing a lowered level setting of an appliance pressure switch and provides such selection without requiring altering of the initial calibration of the pressure switch.

DETAILED DESCRIPTION

Figure 3:
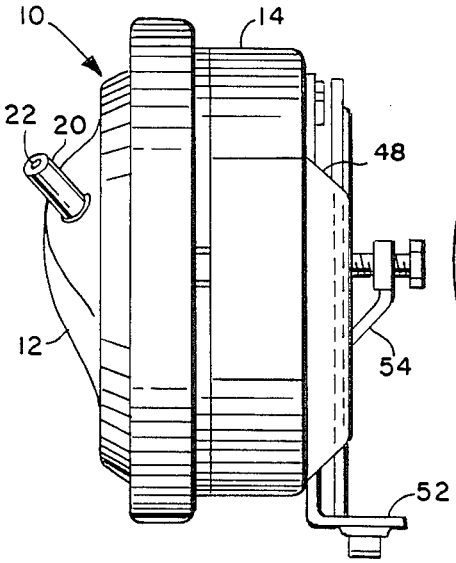
FIG. 3 is a left side view of FIG. 2.
Figure 2:
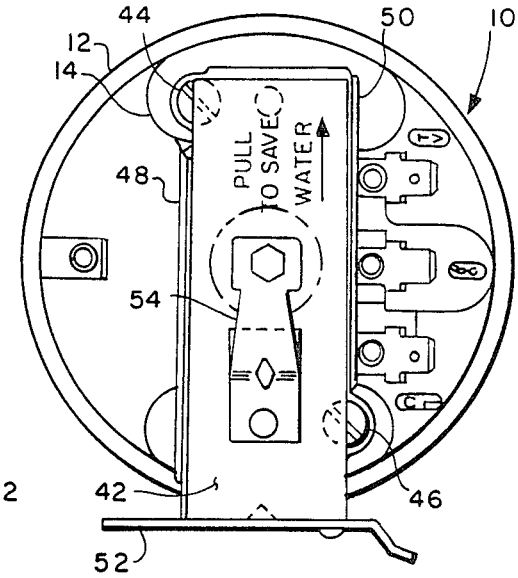
FIG. 2 is a top view of the embodiment of FIG. 1.
Figure 1:
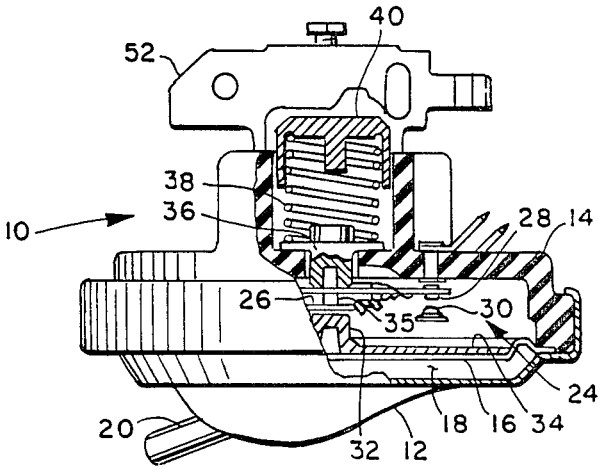
FIG. 1 is a side elevation view of the pressure switch with portions of the housing broken away.

Referring to FIGS. 1 through 4, the pressure switch is indicated generally at 10 as having a housing comprising a lower portion or shell 12 having its periphery formed over the rim of an upper housing portion 14 with a pressure responsive diaphram 16 captured about its periphery between the upper and lower housing portions. The lower housing shell 12 and the diaphram 16 form therebetween a pressure sensing chamber 18; and, the chamber 18 is adapted for connection to a source of pressure by a connector tube 20 having the interior thereof forming a port 22 communicating with the chamber 18.

A snap-acting switch mechanism indicated generally at 24 has an actuator 26 movable for effecting actuation and deactuation of the electrical contacts 28, 30 upon movement upon the actuator 26. A plunger member 32 contacts the switch actuator 26 and has a flanged portion 34 which provides the rigid backing to the diaphragm for movement therewith. Plunger 32 has a guide portion 35 which extends upwardly through the switch mechanism for engagement with a moveable stop 36 which is guided in the housing for sliding movement and which slidably engages guide portion 35 and is located thereby.

A suitable bias spring 38 has one reaction end thereof registered against the moveable stop 36 and the upper reaction end thereof loaded against a stop means via cap 40 in a manner as will hereinafter be described in greater detail.

Referring to FIGS. 1–4, a suitable mounting bracket 42 is attached to the upper housing portion 14 by suitable means such as fasteners 44, 46. The mounting bracket has in transverse section a generally U-shaped configuration with oppositely disposed parallel upturned side flanges or rails 48, 50 and an end flange 52 which is adapted for connection to the appliance to be controlled. Bracket 42 has preferably integrally formed therewith an arm portion 54 which extends outwardly therefrom.

Figure 4:
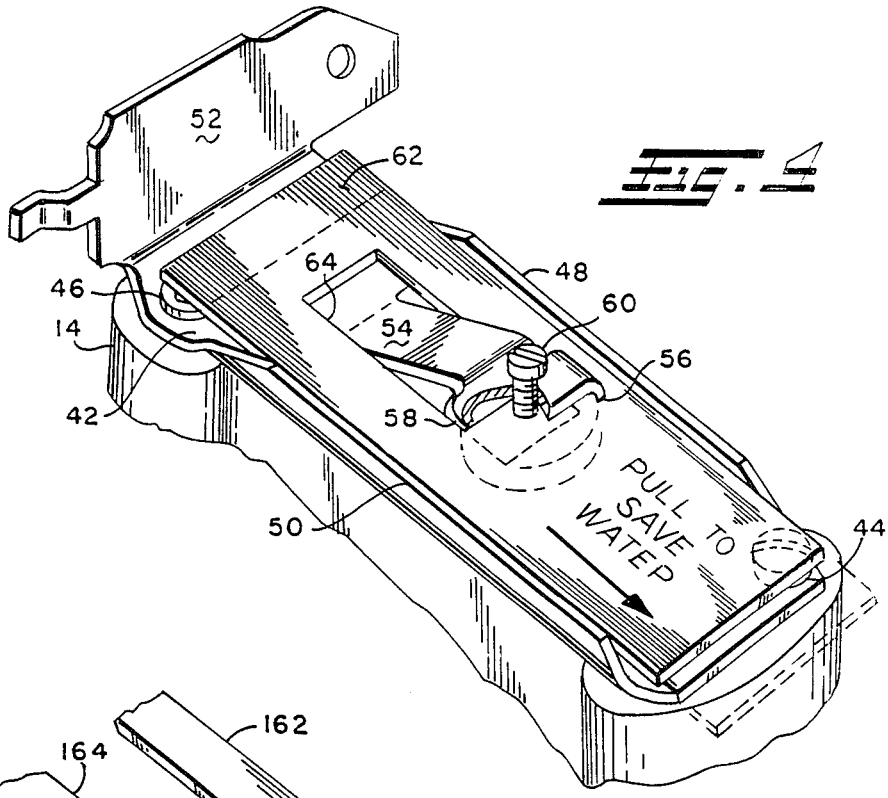
FIG. 4 is an enlarged perspective view of a portion of the embodiment of FIG. 1 illustrating the mounting bracket and pull tab.

Referring to FIG. 4, bracket arm 54 has formed on the outward end thereof spaced parallel downturned edges 56, 58 and has an adjustment screw 60 threaded therethrough.

A movable change member 62 having a preferably elongated thin strip configuration has a cutout 64 provided therein; and, the member 62 is received in the mounting bracket between the rails 48, 50. The mounting bracket arm 54 extends upwardly through the cutout 64. The cutout 64 extends along the length of a moveable strip 62 a sufficient distance to enable movement of the strip in its longitudinal direction until the screw 60 is directly over the cutout. In FIG. 4 strip 62 is shown in its extreme leftward position in solid outline, with the end thereof in contact or closely adjacent to the flange 52 of the mounting bracket. The extreme rightward position of the strip 62 is shown in FIG. 4 in dashed outline in the second position wherein the cutout 64 is under the screw 60 enabling the spring cap 40 to contact the end of the screw 60, which thus serves directly as the stop means for the spring cap 40. It will be understood that when the moveable member 62 is in its leftward most position as shown in solid outline, that the spring cap 40 is separated from the end of the screw 60 by an amount equal to the thickness of the strip 62. In the presently preferred practice of the invention, the moveable strip 62 is formed of polypropylene plastic material.

Figure 5:
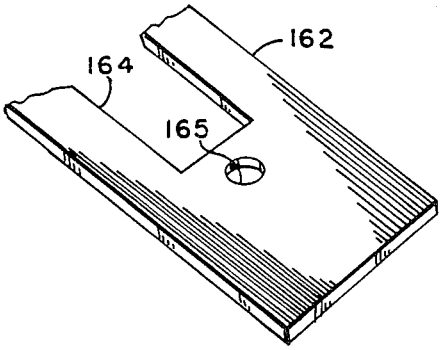
FIG. 5 is a portion of a view similar to FIG. 4 illustrating another embodiment of the invention; and, FIG. 6 is a portion of a view similar to FIG. 4 illustrating an additional embodiment of the invention.

Referring now to FIG. 5 an alternate arrangement of the strip 162 is shown wherein the cutout 164 has an auxiliary aperture 165 provided adjacent to the end thereof. The aperture 165 is so located such that when the aperture 165 is directly in line with the screw 60, the force of spring 38 pushes cap 40 against the undersurface of strip 162 and pushes the strip upwardly until the end of screw 60 extends through aperture 165 and contacts the cap 40 directly.

Figure 6:
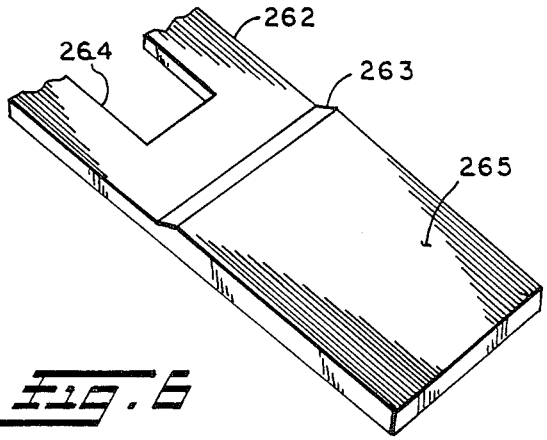

Referring to FIG. 6, another embodiment of the invention is illustrated wherein the strip 262 has the end portion 265 thereof formed to a first thickness; and, the portion containing cutout 264 is formed to a lesser thickness with region of the lesser thickness provided adjacent the end of the cutout 264, and an intermediate step 263 provided therebetween.

In operation of the embodiment of FIG. 6, the strip 262 has three individual provisions with respect to the end of screw 60. In the first or extreme leftward position of strip 262 the screw 60 is separated from the spring cap 40 by the greater thickness 265 of the strip; and, in the second or intermediate position of strip 262 the end of the screw 60 is separated from the spring cap 40 by the lesser thickness in the region intermediate the step 263 and the end of cutout 264; and in a third or extreme rightward position of strip 262 the end of screw 60 is extended through the slot 264 for contacting spring cap 40 directly.

The present invention thus provides a unique and novel way of enabling a pressure switch to be set for plural levels of switch actuation without altering the original calibration of the switch. The present invention employs a unique plastic strip insertable on the switch without requirement for any modifications thereto. The strip being moveable between the first and second positions for providing a shim between the end of the calibration spring and the adjustable stop readily provides for changing the actuation point of the switch.

Although the invention has hereinabove been described with reference to the illustrated embodiments, it will be understood that the invention is capable of modification and variation; and, is limited only by the following claims.

What is claimed is:

1. A bi-level pressure switch for an appliance comprising:

(a) housing means defining a cavity having an inlet adapted for connection to the pressure to be sensed and a diaphragm moveable in response to changes in pressure in said cavity;

(b) snap acting switch means mounted in said housing and having an actuator operable upon movement to effect actuation and de-actuation of said switch means;

(c) plunger means attached to said diaphragm and moveable therewith for contacting said actuator for effecting movement thereof;

(d) spring means biasing said plunger means in a direction to de-actuate said switch means;

(e) stop means defining a registration surface for said bias means and a moveable member for changing the bias force of said bias means between a first and second level, said moveable member having a predetermined thickness, said member moveable between a first position wherein said predetermined thickness disposed intermediate said bias means and said registration surface and a second position wherein said registration surface is not disposed intermediate said bias means and said registration surface, wherein said switch means is caused to actuate at one level with said moveable member in said first position and caused to actuate at another level with said moveable member in said second position.

2. The pressure switch defined in claim 1, wherein said bias means contacts said registration surface in said second position.

3. The pressure switch defined in claim 2, wherein said stop means includes an adjustment screw axially adjustable in the direction of movement of said plunger and said moveable member is slideable in a direction generally at right angles to the axial direction of said screw.

4. The pressure swith defined in claim 1, wherein said stop means includes an arm member extending through said cut-out in said first and second positions, said arm member including portions operative to retain said strip on said housing.

5. The pressure switch defined in claim 2, comprising a mounting bracket attached to said housing, said bracket having an arm portion formed integrally therewith and said arm extending therefrom, including said stop means, said arm portion extending through said cut-out of said moveable member.

6. The pressure switch defined in claim 1, wherein said moveable member comprises an elongated strip having portions of first and second predetermined thicknesses with said first thickness intermediate said registration surface and said bias means in said first position and said second thickness intermediate said registration surface and said bias means.

7. The pressure switch defined in claim 1 wherein said stop means comprises a portion of a mounting bracket attached to said housing, said portion of said bracket operable to retain said moveable member on said pressure switch.

8. The pressure switch defined in claim 1 wherein said stop means comprises first portion of mounting bracket means attached to said housing, and operable to retain said moveable member thereon; and, said bracket means includes other portions defining spaced generally parallel guide surface for guiding movement of said moveable member.

9. The pressure switch defined in claim 7, wherein said bracket has a pair of spaced generally parallel guide surfaces operative to contact said level change member and direct the movement thereof.

10. The pressure switch defined in claim 7, wherein said stop means include adjustment means.

11. The pressure switch defined in claim 7, wherein said level change member comprises an elongated generally thin plastic strip.

12. The pressure switch defined in claim 7, wherein said level change member is formed of polypropylene material.

13. The pressure switch defined in claim 7, wherein said level change member includes an aperture therethrough disposed adjacent said cut-out, said aperture operative in said second position disposed between said spring opposite reaction end and said stop means for changing the preload of said spring means on said diaphragm for changing the pressure at which said switch is actuated.

14. The pressure switch defined in claim 13, wherein said member has a cut-out therein, and said member is moveable to a third position wherein said spring means opposite reaction end extends through said cut-out and contacts said stop means directly.

15. The pressure switch defined in claim 13, wherein said stop means is adjustable independently of said moveable member for calibrating said switch.

16. The pressure switch defined in claim 13, wherein said bracket defines a pair of spaced guide surface for directing movement of said level change member.

17. In a pressure switch of the type having a housing and snap acting switch therein actuated by a pressure responsive diaphragm, the improvement comprising:

(a) a mounting bracket attached to said housing and having an arm portion extending therefrom, said arm portion having stop means thereon;

(b) spring means having one reaction end thereof loading against said diaphragm and the opposite reaction end loaded against said stop means; and, (c) a calibration change member received on said bracket, said change member moveable between a first position wherein a portion of said member having a predetermined thickness is disposed intermediate said spring means and said stop means and a second position in which said predetermined thickness is not intermediate said spring means and said stop means.

* * * * *